US005526722A

United States Patent [19]

Limehouse

[11] Patent Number: 5,526,722

[45] Date of Patent: Jun. 18, 1996

[54] IMPACT TOOL FOR REMOVING BOLTS

[76] Inventor: William L. Limehouse, 1468 S. Edgewater Dr., Charleston, S.C. 29407

[21] Appl. No.: 406,208

[22] Filed: Mar. 17, 1995

[51] Int. Cl.[6] ..... B25B 19/00

[52] U.S. Cl. ..... 81/466; 81/463; 173/90

[58] Field of Search ..... 173/90, 91; 81/463, 81/465, 466

[56] References Cited

U.S. PATENT DOCUMENTS

| | | | |
|---|---|---|---|
| 1,925,714 | 9/1933 | Crist | 81/463 |
| 2,564,224 | 8/1951 | Mitchell et al. | 81/466 |
| 2,626,641 | 1/1953 | Martell . | |
| 3,011,480 | 12/1961 | Vilmerding | 81/463 |
| 3,508,455 | 4/1970 | Miller . | |
| 4,007,651 | 2/1977 | Scott . | |
| 4,403,725 | 9/1983 | Lawrence . | |
| 4,669,341 | 6/1987 | Small . | |
| 4,676,424 | 6/1987 | Meador et al. . | |
| 4,805,495 | 2/1989 | Tauber . | |
| 4,864,902 | 9/1989 | Doorley | 81/466 |
| 4,901,712 | 2/1990 | Voegell et al. . | |
| 4,960,235 | 10/1990 | Gregory . | |
| 5,009,133 | 4/1991 | Carey . | |
| 5,321,999 | 6/1994 | Lin | 81/463 |

FOREIGN PATENT DOCUMENTS

| | | | |
|---|---|---|---|
| 803270 | 9/1936 | France | 81/463 |

*Primary Examiner*—Bruce M. Kisliuk
*Assistant Examiner*—Joni B. Danganan
*Attorney, Agent, or Firm*—Dority & Manning

[57] ABSTRACT

An impact tool for removing bolts includes axially aligned impact section, torque section and shaft. The shaft is configured to extend through a socket to abut a bolt head when the socket is in operative communication with the bolt head. The shaft is additionally configured such that a torque applied to the shaft is transferred to the socket. The shaft defines a shaft face that abuts the bolt head. The impact section defines an impact face on the opposite end of the tool from the shaft face. The torque section is configured such that a torque applied thereto is transferred to the shaft. Accordingly, a blow to the impact face transfers an axial force to the bolt at the interface between the bolt head and the shaft face. Such axial force may tend to break a corrosive bond between the threads of the bolt and the receiving surface. Thus, axial blows to the tool in combination with torque applied to the torque section may tend to loosen and remove frozen bolts. A system according to the present invention additionally comprises an impact instrument, a torque instrument and a socket.

12 Claims, 4 Drawing Sheets

IMPACT TOOL FOR REMOVING BOLTS

BACKGROUND OF THE INVENTION

The present invention generally concerns tools for removing bolts. More particularly, the invention relates to a tool having an improved construction for delivering an axial force and a torque to a bolt.

It is generally understood that applying an axial force on a screwdriver may aid in loosening hard to remove, or "frozen," screws or in tightening screws in tight fits. Accordingly, devices are known in the art for applying an axial force on a screw while simultaneously applying a torque to loosen or tighten the screw.

Such axial force is more difficult to apply to bolts using typical socket wrenches which generally do not provide a direct axial connection to the bolt head. Thus, conventional socket wrenches are generally capable of applying only a torque to a bolt head. Such force may be inadequate to dislodge bolts "frozen" due to thread corrosion. Such conditions are often encountered, for example, in farm equipment left outdoors for long periods of time.

Thus, it would be desirable to have a bolt removal tool that could simultaneously provide torque and an axial force to dislodge a frozen bolt.

SUMMARY OF THE INVENTION

The present invention recognizes and addresses the foregoing disadvantages, and others, of prior art constructions and methods.

Accordingly, it is an object of the present invention to provide an impact tool for removing bolts.

It is a more particular object of the present invention to provide an impact tool for removing bolts that simultaneously provides an axial force and a torque to a bolt head.

Additional objects and advantages of the invention will be set forth in the following description, or may be obvious from the description, or may be learned through practice of the invention.

The objects may be accomplished by an improved bolt removal tool constructed in accordance with the present invention. One preferred embodiment of such a tool assembly comprises an elongated shaft defining a shaft face. The shaft fits into a socket such that rotation of the shaft turns the socket. Furthermore, the shaft extends through the socket such that the shaft face abuts the bolt head over which the socket is placed. The shaft is thus configured to deliver an axial force directly to the bolt head at the shaft face and a torque indirectly thereto through the socket.

The tool additionally comprises a torque section in communication with the shaft such that a torque received by the torque section is transferred to the shaft. In one preferred embodiment, the torque section is integral with the shaft and axially aligned therewith. Furthermore, the torque section has multiple sides such that typical open ended or box wrenches may be applied thereto.

In another preferred embodiment, the torque section comprises a multi-sided ring axially aligned with the shaft but slidably attached thereto. In this embodiment, the distance between the shaft face and the torque section is variable. Accordingly, when the shaft extends through the socket to the bolt head, the torque section may be positioned at the socket so that the torque load may be applied as close as possible to the bolt. Such a configuration is also advantageous when using larger sockets wherein the shaft must extend a relatively greater distance therethrough. Accordingly, this configuration permits the extension of the shaft to any bolt head while placing the torque load as close to the bolt head as possible.

The tool additionally comprises an impact section axially aligned with the shaft and defining an impact face on an opposite end of the tool from the shaft face. The impact section is integrally attached to the shaft so that tool transfers the force of a blow from an impact instrument, for example a hammer, at the impact section to the bolt head at the shaft face.

Accordingly, an impact tool system constructed in accordance with the present invention includes a tool as generally described above with a socket, at least one wrench, and a hammer. In use, the socket is placed over the bolt head, as is commonly understood. The shaft of the tool is inserted through the top of the socket, where a conventional socket wrench would attach, such that the shaft face abuts the bolt head. At least one wrench may then be applied to the torque section and a torque applied thereto. As the torque is applied, the hammer may strike the impact section, thus tending to break the corrosive bond between the bolt threads and the hole threads and permitting the torque to turn and loosen the bolt.

Other objects, features, and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
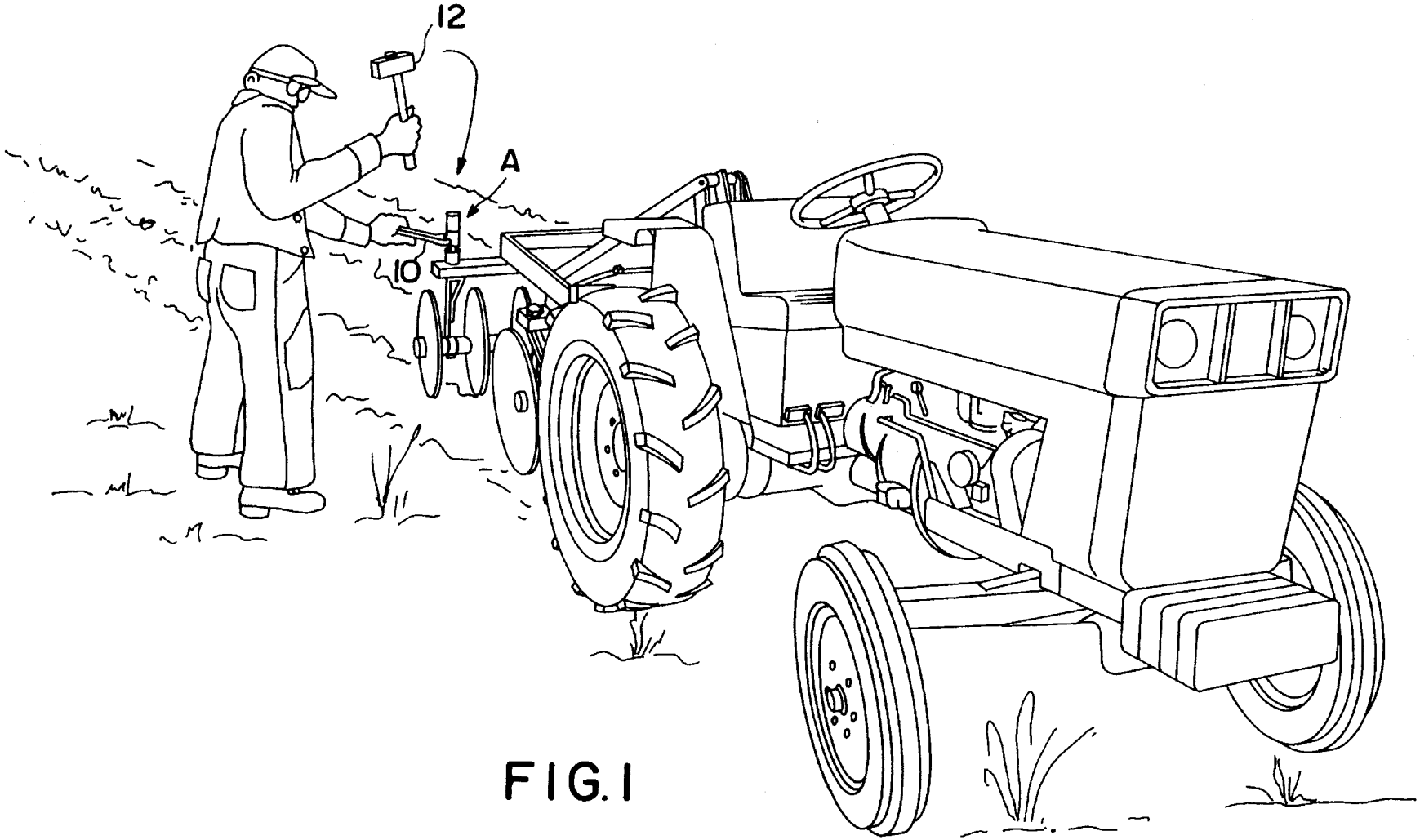
FIG. 1 is perspective component and operational view illustrating a preferred embodiment of the present invention in use.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

As described above, farm equipment operators often encounter difficulties in adjusting or interchanging equipment parts due to corroded bolts. Accordingly, referring particularly to FIG. 1, an operator may employ an impact tool for removing bolts according to the present invention, indicated generally at A, for loosening and removing such "frozen" bolts. As indicated, a torque imparting device, for example wrench 10, applies a torque to tool A, and thus to the bolt while a hammer 12 simultaneously strikes tool A to dislodge corrosive threads.

Figure 2:
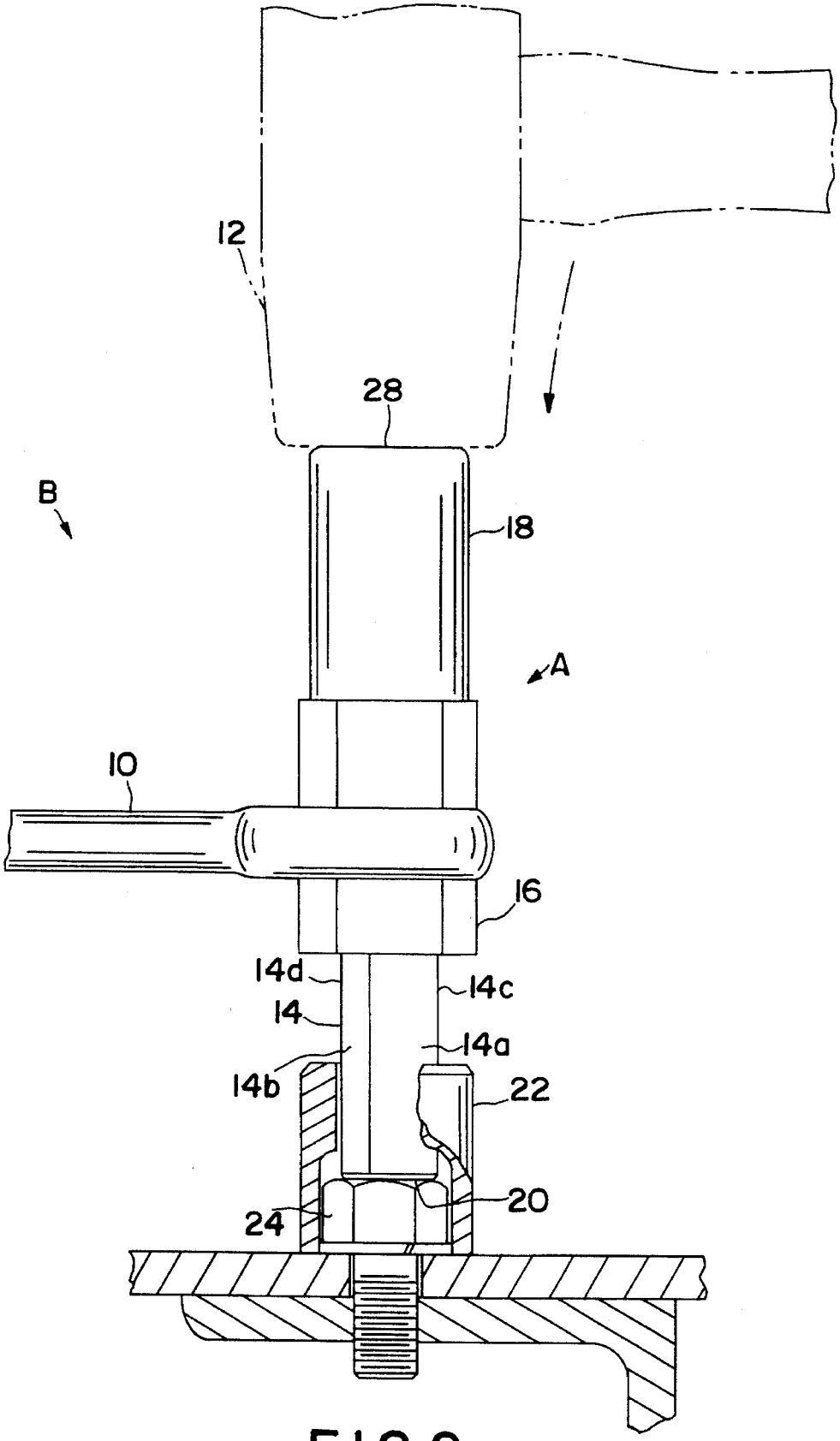
FIG. 2 is an elevational view of the system according to the present invention showing a socket in partial cross section.

An impact tool system, indicated generally at B, is illustrated in FIG. 2. Impact tool A generally comprises an elongated shaft 14, a torque section 16 and an impact section 18. Elongated shaft 14 defines a shaft face 20 and sides 14*a*, 14*b*, 14*c* (not shown), and 14*d* (not shown).

Socket 22 defines an open end 23 (FIG. 4) configured to fit over bolt head 24 in operative communication therewith. Shaft 14 extends through socket 22 such that shaft face 20 abuts bolt head 24. As is more clearly shown in the expanded view in FIG. 6, shaft sides 14*a* through 14*d*, when received by socket 22, oppose respective inner walls 22*a*, 22*b*, 22*c*, and 22*d*. Thus, when shaft 14 is inserted into socket 22 through a passageway defined in socket face 25, the shaft sides engage the respective four inner socket walls such that torque applied to shaft 14 is transferred to socket 22.

Those of ordinary skill in the art should understand that socket 22 is shown by way of example only and not by way of limitation. It should be understood that any equivalent device capable of transferring torque from shaft 14 to bolt head 24 is within the scope of the invention. For example, such a device could be integral or united with shaft 14.

Referring again to FIG. 2, torque may be applied to shaft 14 through the cooperation of wrench 10 and torque section 16. As illustrated, torque section 16 has a multi-sided circumference to fit box wrench 10. It should be understood that an open ended wrench (as shown at 10 in FIG. 6) or equivalent device may be used. Furthermore, various other torque section configurations effecting a communication with a torque imparting device are understood to be within the scope of the invention.

Impact section 18 is axially aligned with shaft 14 and defines an impact face 28 on the opposite end of tool A from shaft face 20. Thus, the force from blows received at impact face 28 from an impact instrument such as hammer 12 is axially transmitted to bolt head 24 at the interface between bolt head 24 and shaft face 20.

Figure 5:
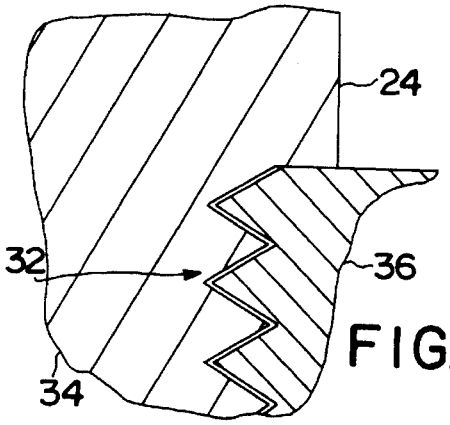
FIG. 5 is a cross sectional view of a threaded interface between a bolt and a threaded hole.

As described above, such axial force may tend to loosen "frozen" bolts. Such condition may be caused by corrosion at the interface 32 between the threads of bolt 34 and receiving surface 36 as illustrated in FIG. 5.

Figure 3:
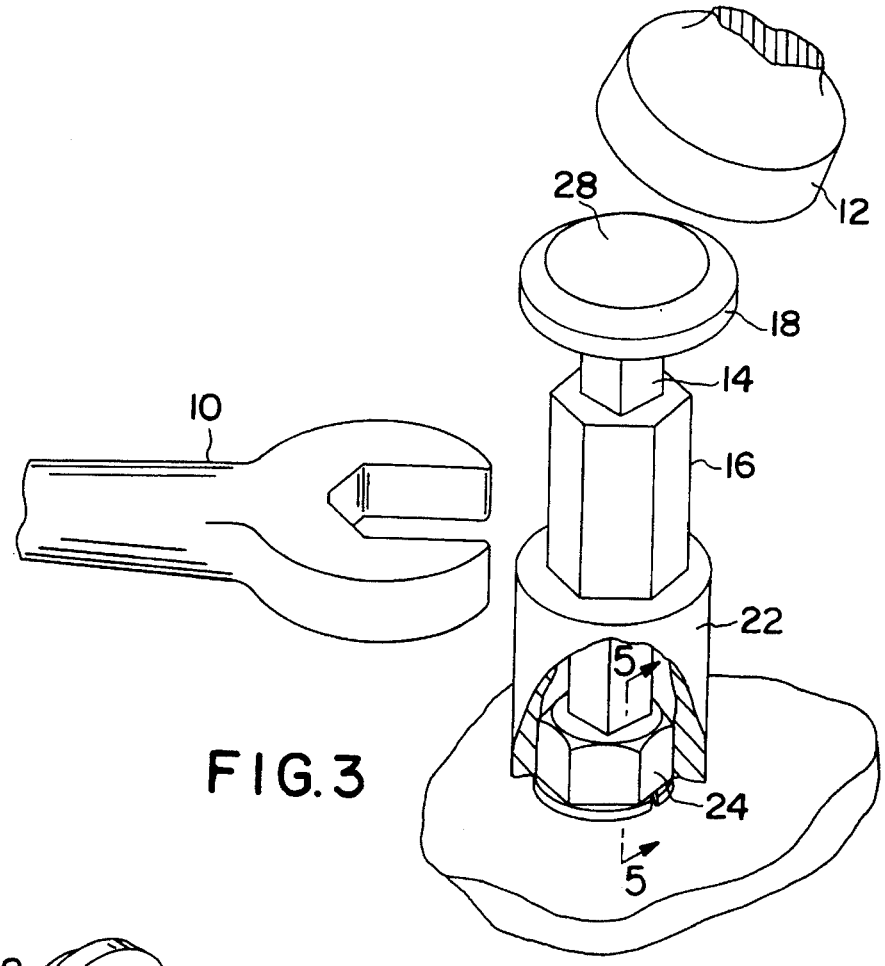
FIG. 3 is a perspective view of another preferred embodiment of the present invention showing a socket in partial cross section.
Figure 4:
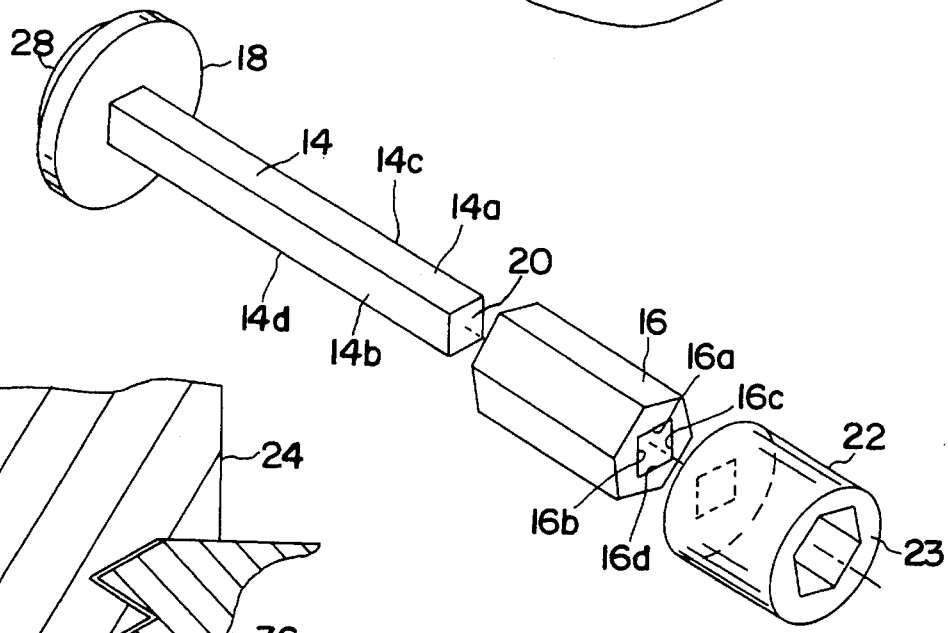
FIG. 4 is an expanded perspective view of the preferred embodiment of the tool according to the present invention as in FIG. 3.
Figure 6:
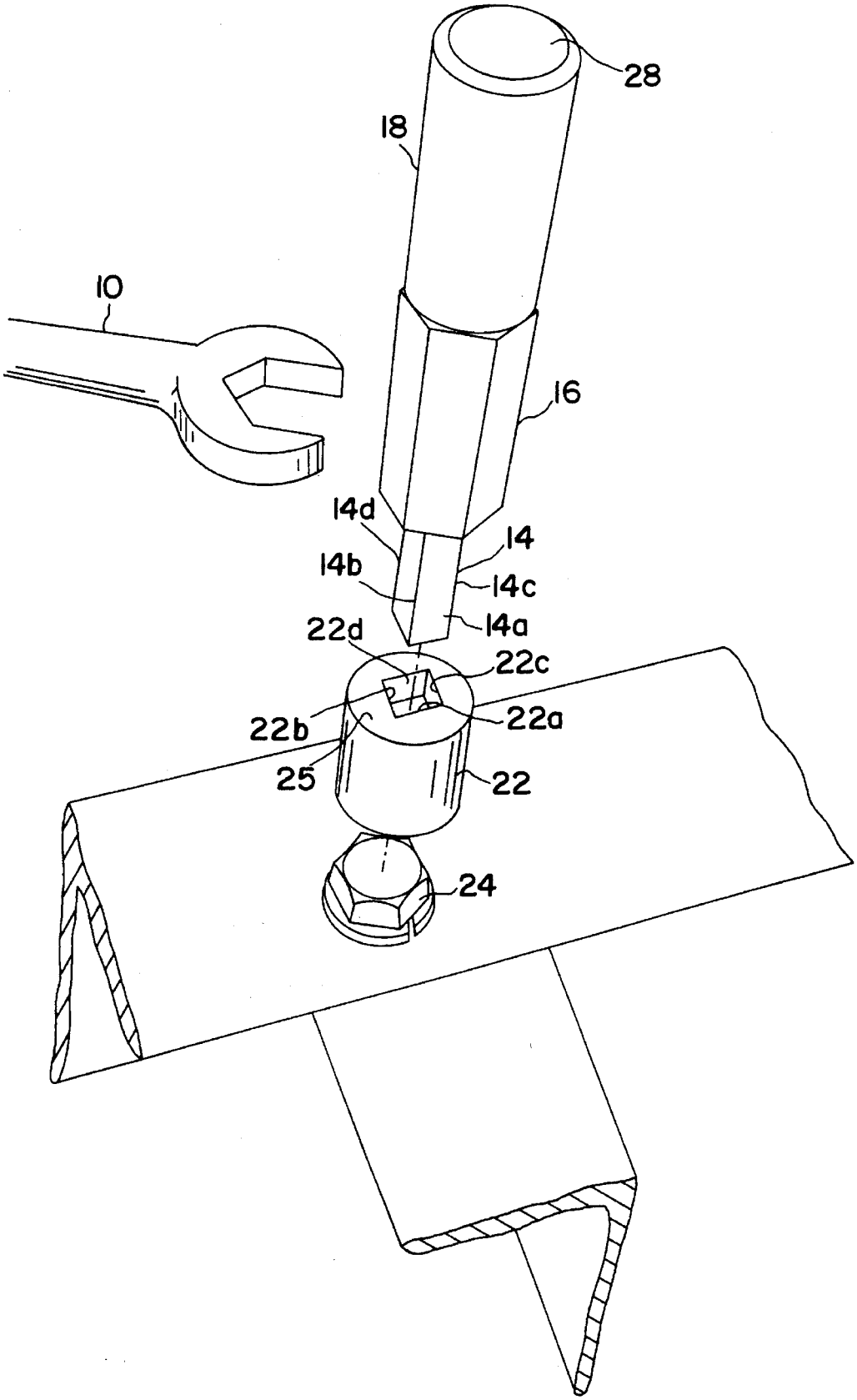
FIG. 6 is an expanded perspective view of the preferred embodiment as in FIG. 2.

As illustrated in FIGS. 2 and 6, impact section 18, torque section 16 and shaft 14 integrally comprise tool A. Alternatively, FIGS. 3 and 4 illustrate another preferred embodiment wherein torque section 16 comprises a multi-sided ring distinct from and configured to slidably receive shaft 14. Such a construction permits shaft 14 to abut bolt head 24 while positioning torque section 16 as close as possible to socket 22 regardless of the depth of socket 22. Thus, the torque load may be applied nearly adjacent to socket 22.

FIG. 4 illustrates that, when inserted, shaft walls 14*a* through 14*d* respectively oppose and engage torque section inner walls 16*a*, 16*b*, 16*c* and 16*d*. Thus, torque applied by wrench 10 to the faces of torque section 16 is transferred to shaft 14 at the four interfaces. The torque is then transferred to socket 22 at the interfaces of sides 14*a* through 14*d* and the inner walls of socket 22 as described above and thence to bolt head 24.

Accordingly, an axial force delivered through tool A by a blow at impact face 28 to bolt head 24 may tend to loosen a frozen bolt. Thereafter or simultaneously therewith, a torque applied through wrench 10, torque section 16, shaft 14 and socket 22 to bolt head 24 may tend to turn the bolt.

Those of ordinary skill in the art should understand that various equivalent constructions are possible within the scope and spirit of the present invention. For example, features illustrated or described as part of one embodiment may be used on another embodiment to yield a still further embodiment. Thus, tools having many equivalent configurations and designs may be achieved. Any and all such equivalent impact tools utilizing the construction of the present invention are understood to be within the scope of the invention. Accordingly, those of ordinary skill in the art will appreciate that the foregoing description is by way of example only, and is not intended to limit the invention so further described in such appended claims.

What is claimed is:

1. An impact tool for removing bolts, said tool comprising:

an elongated shaft defining a shaft face, said shaft configured to operatively engage a socket operatively engaging a bolt head and to extend therethrough such that said shaft face abuts the bolt head;

a torque section having a circumference configured to operatively receive a torque imparting device, said torque section being in communication with said shaft so that torque received by said torque section is transferred to said shaft; and an impact section axially aligned with and in operative communication with said shaft and defining an impact face on an opposite end of the tool from said shaft face, said impact section configured to receive blows from an impact instrument at said impact face and to transfer the force of said blows to the bolt head through said shaft at said shaft face.

2. The impact tool as in claim 1, wherein said shaft defines four sides.

3. The impact tool as in claim 2, wherein said shaft defines sides configured to engage respective four inner walls of the socket such that torque applied to said torque section and transferred to said shaft transfers to the four inner socket walls.

4. The impact tool as in claim 1, wherein said torque section comprises a multi-sided ring aligned axially with respect to said shaft and said impact section and between said shaft face and said impact face.

5. The impact tool as in claim 4, wherein said torque section is integrally affixed to the tool.

6. The impact tool as in claim 4, wherein said shaft is configured to be slidably received within and through said torque section.

7. The impact tool as in claim 6, wherein said shaft defines four sides configured to engage respective four inner walls of the socket and respective four inner walls of said torque section when inserted therethrough such that torque applied to said torque section transfers to the four shaft walls and thereby transfers to the four inner socket walls.

8. The impact tool as in claim 4, wherein said ring comprises six sides and is configured to receive a wrench.

9. An impact tool system for removing bolts, said system comprising:

an elongated shaft defining a shaft face;

a socket having an open end configured to operatively communicate with a bolt head to apply torque thereto and having a passageway opposite said open end and configured to operatively receive at least part of said shaft such that said shaft face abuts the bolt head and such that said shaft engages said socket so that torque applied to said shaft transfers to said socket;

a torque section having a circumference configured to receive a torque imparting device, said torque section in communication with said shaft such that torque received thereby is transferred to said shaft; and an impact section axially aligned with said shaft and defining an impact face on an opposite end of the tool from said shaft face, said impact section configured to receive blows from an impact instrument at said impact face and to transfer the force of said blows to the bolt head through said shaft at said shaft face.

10. The impact tool system as in claim 9, further comprising a torque imparting device configured to apply torque to said torque section.

11. The impact tool system as in claim 10, wherein said torque imparting device comprises at least one wrench.

12. The impact tool system as in claim 9, further comprising a hammer configured to strike said impact section.

* * * * *